US012247776B2

(12) United States Patent
Hunter et al.

(10) Patent No.: US 12,247,776 B2
(45) Date of Patent: Mar. 11, 2025

(54) VIS DOOR REINFORCEMENT BRACKET DESIGN

(71) Applicant: WHIRLPOOL CORPORATION, Benton Harbor, MI (US)

(72) Inventors: Lynne Foster Hunter, Dorr, MI (US); Jackson Felipe Karl, Stevensville, MI (US); Marcel Bögger Lessa, Joinville (BR); Abhay Naik, Stevensville, MI (US); Sanket Vivek Phalak, Pune (IN)

(73) Assignee: Whirlpool Corporation

( * ) Notice: Subject to any disclaimer, the term of this patent is extended or adjusted under 35 U.S.C. 154(b) by 163 days.

(21) Appl. No.: 18/054,338

(22) Filed: Nov. 10, 2022

(65) Prior Publication Data

US 2024/0159452 A1 May 16, 2024

(51) Int. Cl.
*F25D 23/02* (2006.01)

(52) U.S. Cl.
CPC ..... *F25D 23/028* (2013.01)

(58) Field of Classification Search
CPC .. F25D 23/02; F25D 23/028; F25D 2323/024; F25D 23/085; F25D 2201/126; F25D 23/062; E05Y 2900/31; E05Y 2600/626; E05Y 2800/682; E05Y 2900/132
See application file for complete search history.

(56) References Cited

U.S. PATENT DOCUMENTS

| | | | | |
|---|---|---|---|---|
| 4,151,681 | A * | 5/1979 | Roberts | F25D 23/028 49/501 |
| 6,209,265 | B1 * | 4/2001 | Banicevic | F25D 23/028 49/501 |
| 6,926,379 | B1 * | 8/2005 | Grace | F25D 23/028 312/401 |
| 8,881,466 | B2 | 11/2014 | Roberts | |
| 10,514,722 | B1 * | 12/2019 | Artwohl | H05K 5/0017 |
| 10,704,826 | B2 * | 7/2020 | Lee | A47F 3/0434 |
| 2008/0174218 | A1 * | 7/2008 | Leimkuehler | F25D 23/02 312/405 |
| 2008/0180011 | A1 * | 7/2008 | Leimkuehler | F25D 23/02 312/405 |
| 2017/0211874 | A1 * | 7/2017 | Kim | F25D 23/025 |
| 2018/0112909 | A1 * | 4/2018 | Choi | F25D 23/028 |
| 2019/0003762 | A1 * | 1/2019 | Choi | F25D 17/04 |
| 2020/0292226 | A1 * | 9/2020 | Hunter | E05D 7/02 |

(Continued)

FOREIGN PATENT DOCUMENTS

| | | | | |
|---|---|---|---|---|
| CN | 1664479 | A * | 9/2005 | E05D 5/065 |
| CN | 102242588 | A * | 11/2011 | |

(Continued)

*Primary Examiner* — Hiwot E Tefera
(74) *Attorney, Agent, or Firm* — Price Heneveld LLP

(57) ABSTRACT

A vacuum-insulated door comprises a door skin having a perimeter defined by a top edge, a pair of side edges, and a bottom edge spaced from the top edge by the pair of side edges. A vacuum-insulated cell is located in the vacuum-insulated door. A frame assembly includes a top bracket coupled to the top edge, a bottom bracket coupled to the bottom edge, and at least one top hinge pin connected to the top bracket and at least one bottom hinge pin connected to the bottom bracket. The at least one top hinge pin and the at least one bottom hinge pin are configured to connect to a hinge assembly of a cooling appliance.

20 Claims, 12 Drawing Sheets

(56) References Cited

U.S. PATENT DOCUMENTS

| | | | | |
|---|---|---|---|---|
| 2021/0404730 | A1* | 12/2021 | Lee | F25D 23/028 |
| 2022/0221216 | A1 | 7/2022 | Jin | |

FOREIGN PATENT DOCUMENTS

| | | | | |
|---|---|---|---|---|
| CN | 111473576 | A | 7/2020 | |
| CN | 112344630 | A | 2/2021 | |
| EP | 2936013 | B1 | 11/2016 | |
| WO | WO-2013007568 | A2 * | 1/2013 | F16L 59/065 |
| WO | 2014095569 | A1 | 6/2014 | |
| WO | 2021218298 | A1 | 11/2021 | |
| WO | 2022092975 | A1 | 5/2022 | |

* cited by examiner

VIS DOOR REINFORCEMENT BRACKET DESIGN

BACKGROUND OF THE DISCLOSURE

The present disclosure generally relates to a vacuum-insulated door, and more specifically, to a frame assembly for the vacuum-insulated door.

SUMMARY OF THE DISCLOSURE

According to one aspect of the present disclosure, a vacuum-insulated door is provided. The vacuum-insulated door includes a door skin that has a perimeter defined by a top edge, a pair of side edges, and a bottom edge spaced from the top edge by the pair of side edges. A frame assembly includes a top bracket coupled to the top edge, a bottom bracket coupled to the bottom edge, and at least one top hinge pin connected to the top bracket and at least one bottom hinge pin connected to the bottom bracket. The at least one top hinge pin and the at least one bottom hinge pin are configured to connect to a hinge assembly of a cooling appliance.

According to another aspect of the present disclosure, a vacuum-insulated door is provided. The vacuum-insulated door includes a door skin that has a perimeter defined by a top edge, a pair of side edges, and a bottom edge spaced from the top edge by the pair of side edges. A frame assembly includes a side bracket coupled to each of the side edges. A top bracket is coupled to and extends along the top edge and includes top anchor members coupled to and that extend at least partially along each of the side edges. A bottom bracket is coupled to and extends along the bottom edge and includes bottom anchor members coupled to and that extend partially along each of the side edges.

According to yet another aspect of the present disclosure, a vacuum-insulated door is provided. The vacuum-insulated door includes a door skin having a perimeter defined by a top edge, a pair of side edges, and a bottom edge spaced from the top edge by the pair of side edges. A frame assembly includes a pair of side brackets, each side bracket includes a side edge connection plate coupled to one of the side edges and a side-surface connection plate coupled to a front surface or a rear surface of the door skin. A top bracket includes a top edge connection plate coupled to the top edge and a top side-surface connection plate coupled to the front surface or the rear surface of the door skin. A bottom bracket includes a bottom edge connection plate coupled to the bottom edge and a bottom side-surface connection plate coupled to the front surface or the rear surface of the door skin.

These and other features, advantages, and objects of the present disclosure will be further understood and appreciated by those skilled in the art by reference to the following specification, claims, and appended drawings.

Figure 1:
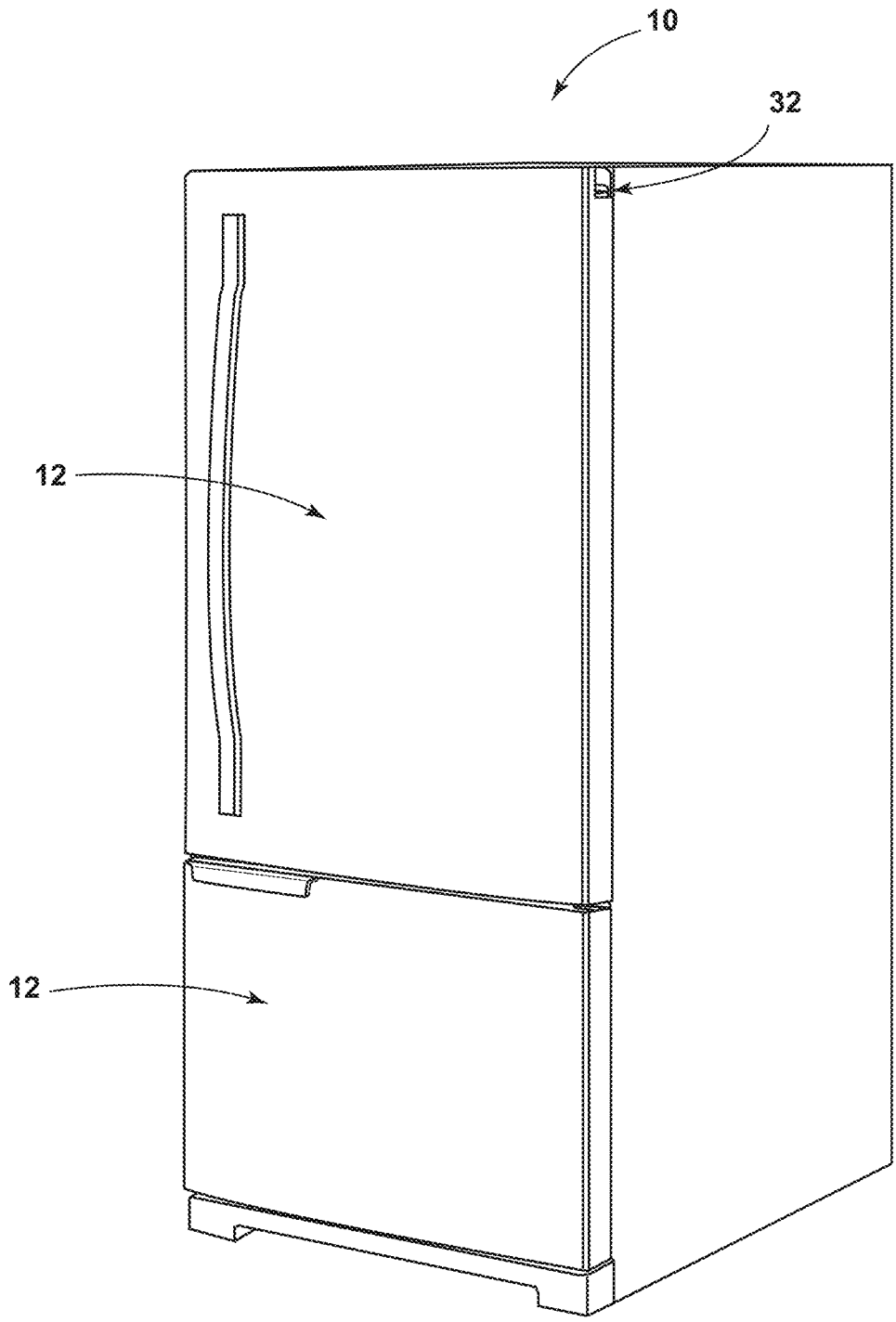
FIG. 1 is a side perspective view of a cooling appliance according to an aspect of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a vacuum-insulated door. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1-7, reference numeral 10 generally designates a cooling appliance (e.g., a refrigerator and/or freezer) with at least one vacuum-insulated door 12 for a refrigerator or freezer compartment. The vacuum-insulated door 12 includes a door skin 14 that has a perimeter defined by a top edge 16, a pair of side edges 18, and a bottom edge 20 that is spaced from the top edge 16 by the pair of side edges 18. A vacuum-insulated cell is located within the vacuum-insulated door 12. A frame assembly 22 includes a top bracket 24 that is coupled to the top edge 16 and a bottom bracket 26 that is coupled to the bottom edge 20. The frame assembly 22 further includes at least one top hinge pin 28 (FIG. 5) that is connected to the top bracket 24 and at least one bottom hinge pin 30 (FIG. 7) that is connected to the bottom bracket 26. The at least one top hinge pin 28 and the at least one bottom hinge pin 30 (FIG. 7) are configured to connect to a hinge assembly 32 (FIG. 12) of the cooling appliance 10. However, it should be appreciated that the top bracket 24 and the bottom bracket 26 may be configured to attach to the hinge assembly 32 by other means, such as other types of mechanical fasteners, welds, and/or the like.

Figure 2:
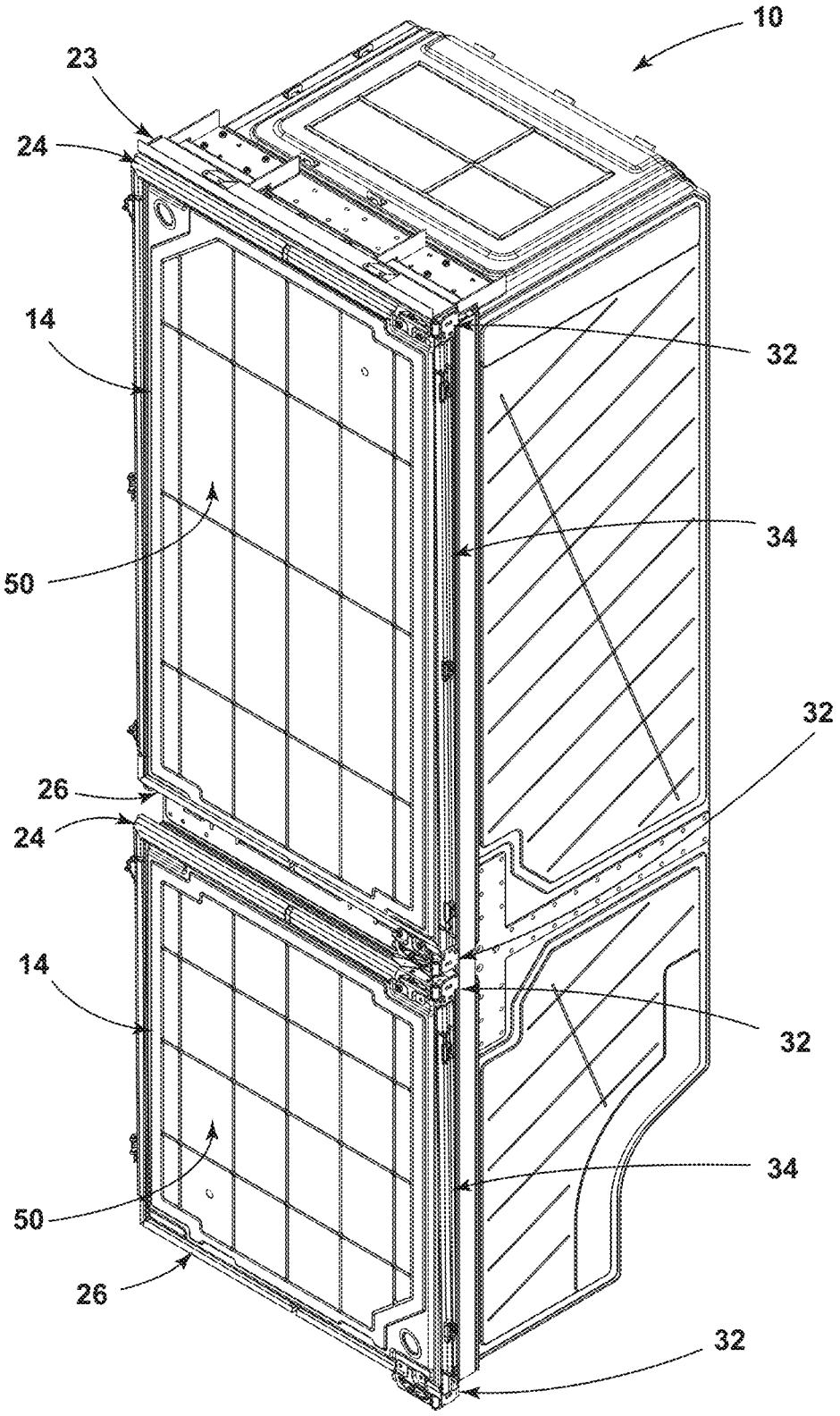
FIG. 2 is a side perspective view of a cooling appliance with an outer layer removed according to an aspect of the present disclosure.
Figure 3:
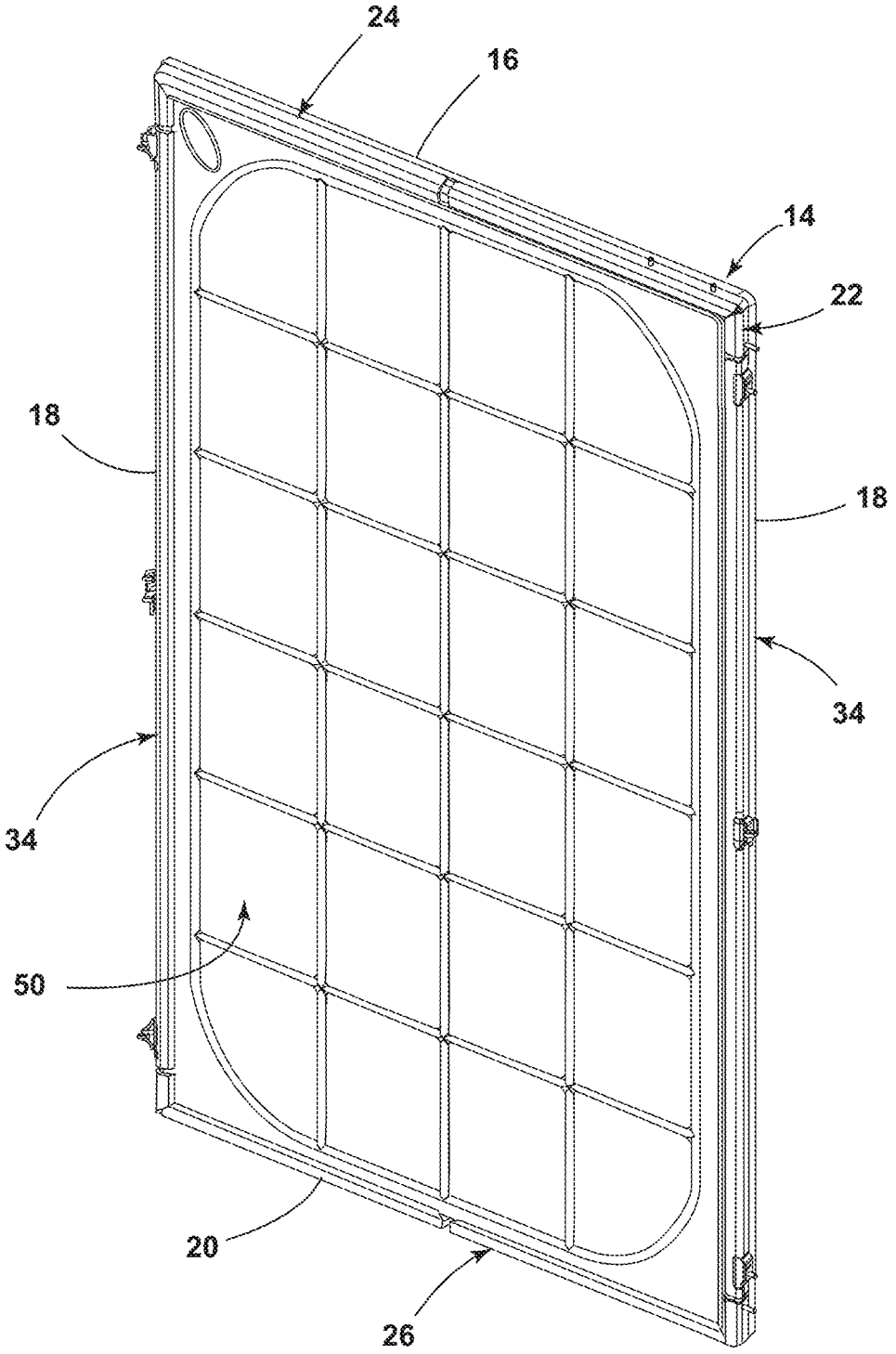
FIG. 3 is a front perspective view of a door skin with a frame assembly according to an aspect of the present disclosure.
Figure 4:
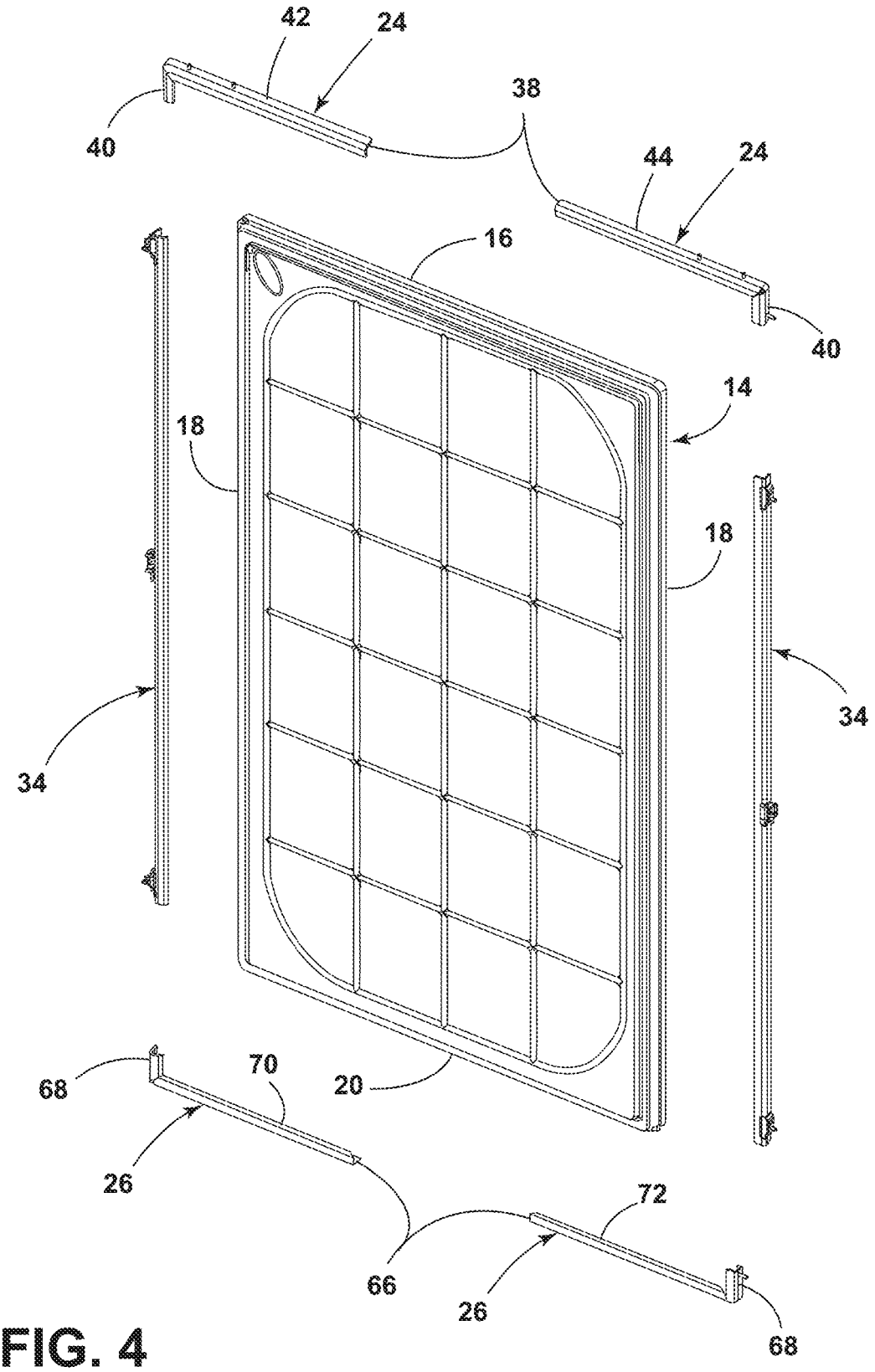
FIG. 4 is a front perspective view of a door skin with a frame assembly in a disassembled state according to an aspect of the present disclosure.

Referring to FIGS. 2-4, the frame assembly 22 includes a pair of side brackets 34 located on opposite side edges 18. The top bracket 24, the bottom bracket 26, and the side brackets 34 may cover substantially the entire perimeter of the door skin 14. For example, the brackets 24, 26, and 34 may cover at least about 80% of the perimeter, at least about 85% of the perimeter, at least about 90% of the perimeter, at least about 95% of the perimeter, at least about 99% of the perimeter, the entire perimeter, or between about 95% and about 99% of the perimeter. In some embodiments, there are spaces 36 between each of the brackets 24, 26, and 34. In this manner, the frame assembly 22 may not extend the entire perimeter. The vacuum-insulated cell is located within the vacuum-insulated door 12. More particularly, the vacuum-insulated door 12 includes a vacuum-insulated structure 23 that includes the door skin 14 and a trim breaker 25 (FIG. 12) that at least partially defines the vacuum-insulated cell.

Figure 5:
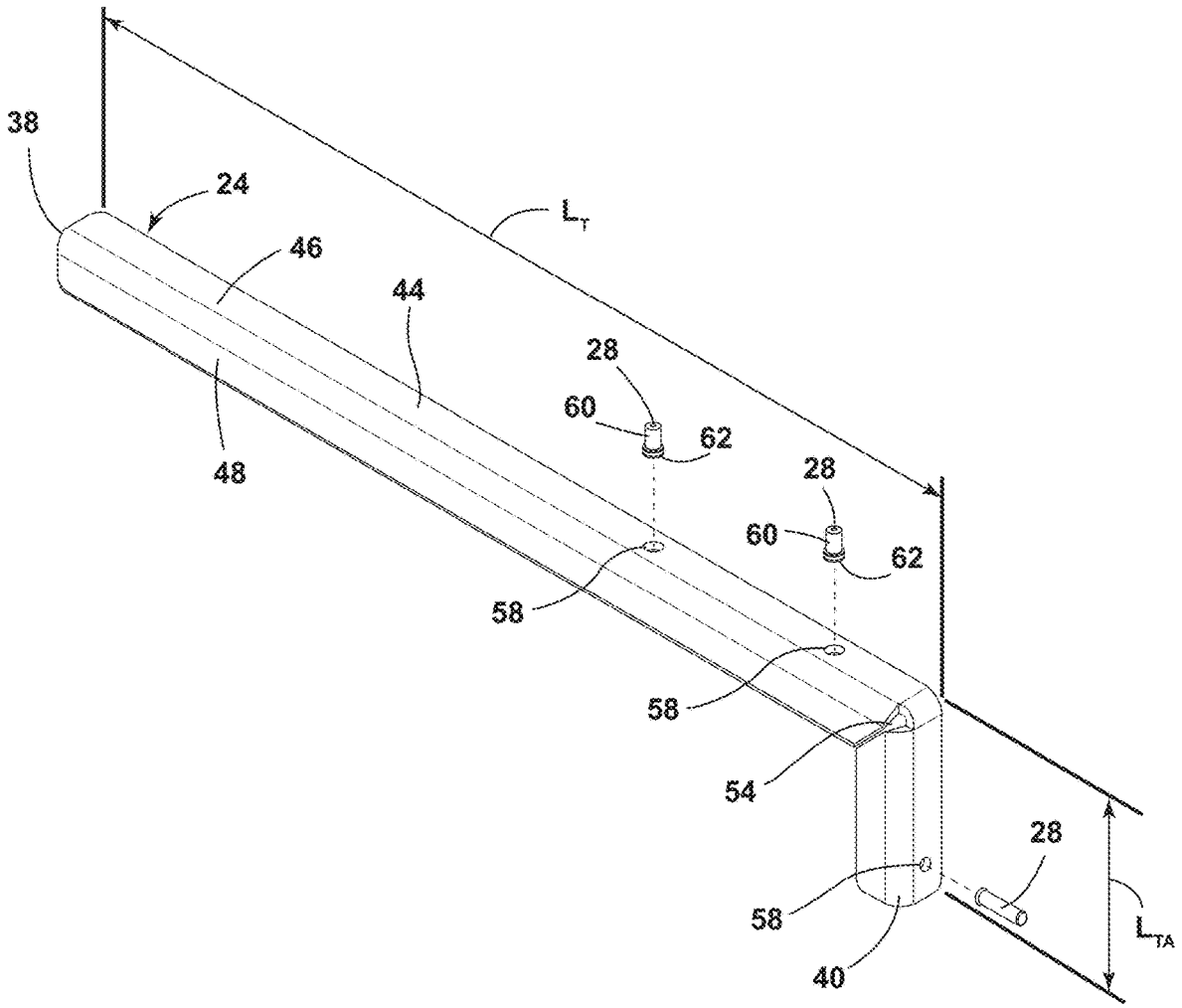
FIG. 5 is a top perspective view of a top bracket according to an aspect of the present disclosure.
Figure 6:
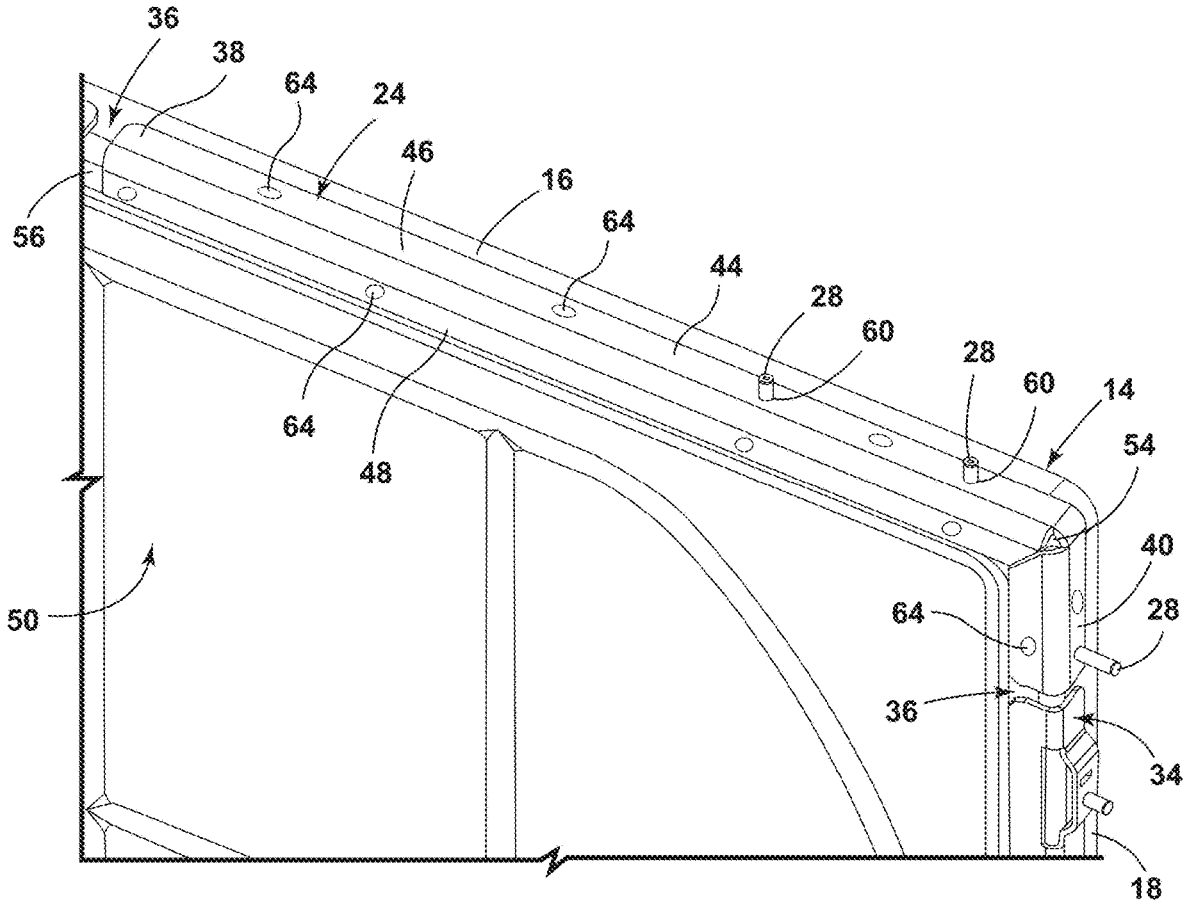
FIG. 6 is a top perspective view of a top bracket connected to a door skin according to an aspect of the present disclosure.

Referring to FIGS. 4-6, the top bracket 24 includes a top longitudinal body 38 that extends between a pair of top anchor members 40. The top longitudinal body 38 extends along the top edge 16 of the perimeter and the top anchor members 40 extend along opposite side edges 18 of the perimeter. As such, an angle (e.g., about 90°) is formed between the top longitudinal body 38 of each of the top anchor members 40. In some embodiments, the top bracket 24 includes a multi-piece construction such that the top longitudinal body 38 has a first top body portion 42 and a second top body portion 44 that are spaced from one another by one of the spaces 36. The first top body portion 42 is connected (e.g., integrally) to one of the top anchor members 40, and the second top body portion 44 is connected (e.g., integrally) to the other top anchor member 40. Each top body portion 42, 44 may define a length "$L_T$" and each anchor member 40 may include a length "LTA" that is shorter than the length $L_T$ by a ratio of at least 2:1, for example, at least 3:1 or at least 4:1 (FIG. 5).

Figure 12:
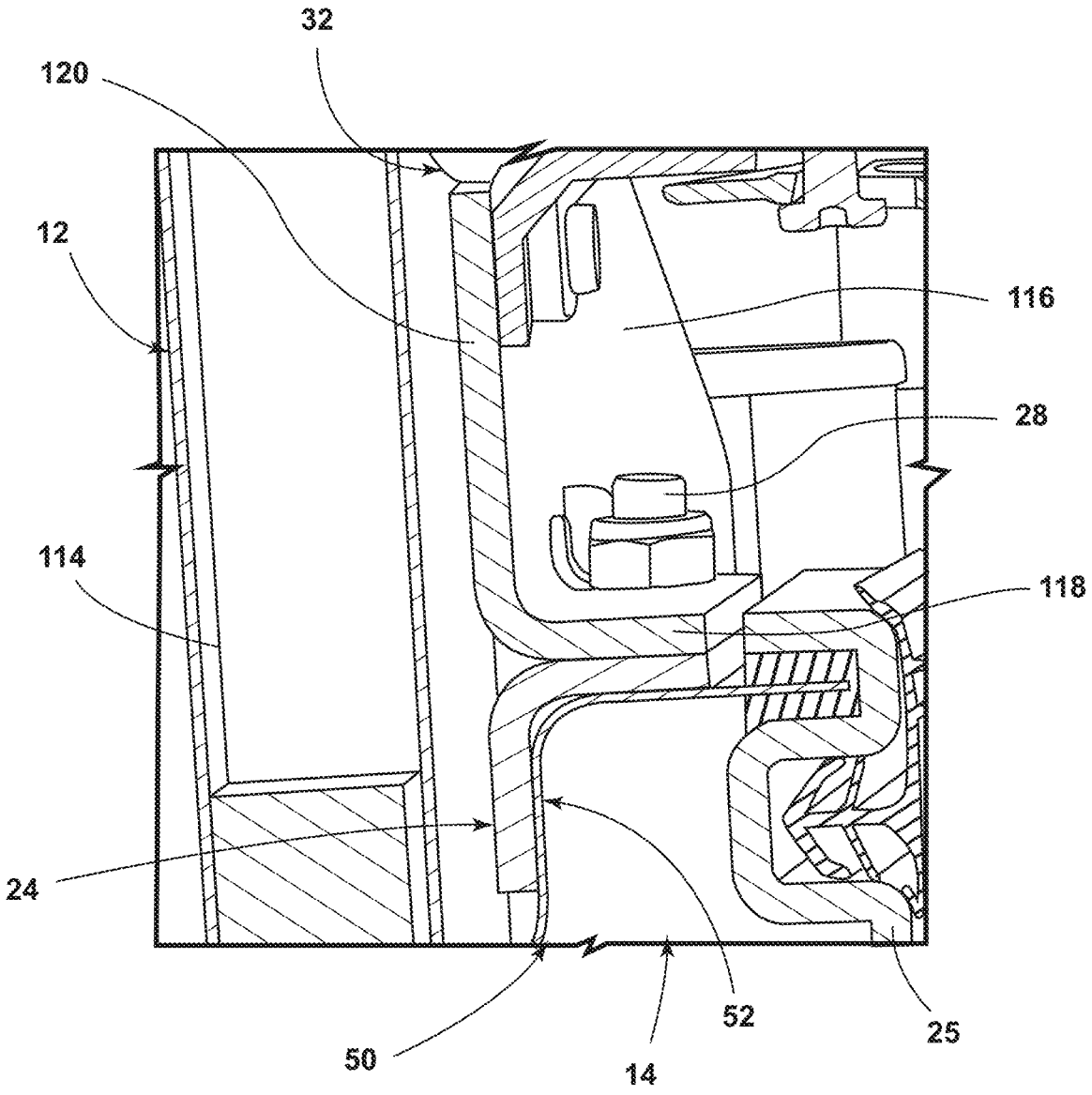
FIG. 12 is a top cross-sectional view of a hinge assembly in a cooling appliance according to an aspect of the present disclosure.
Figure 13:
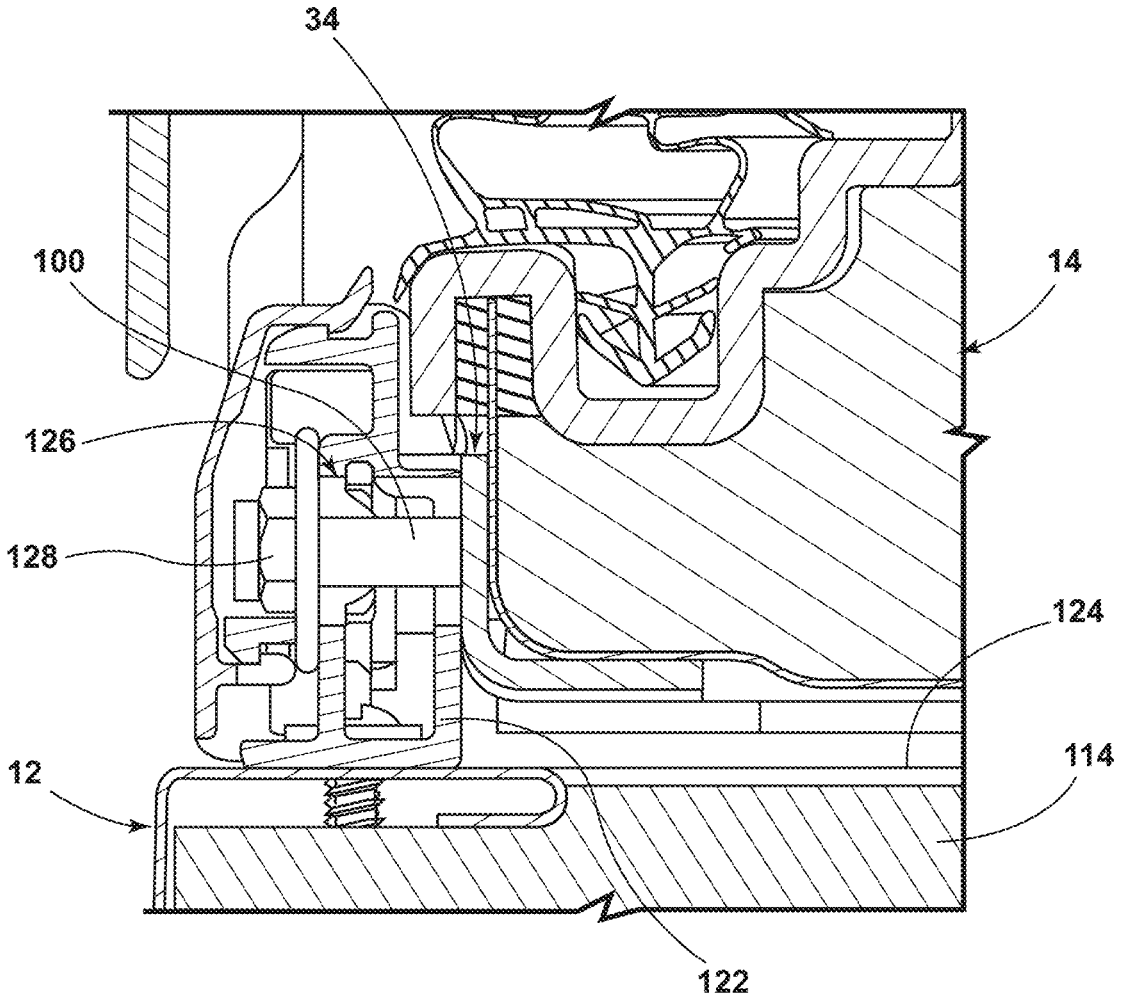
FIG. 13 is a top cross-sectional view of a cosmetic panel according to an aspect of the present disclosure.
Figure 14:
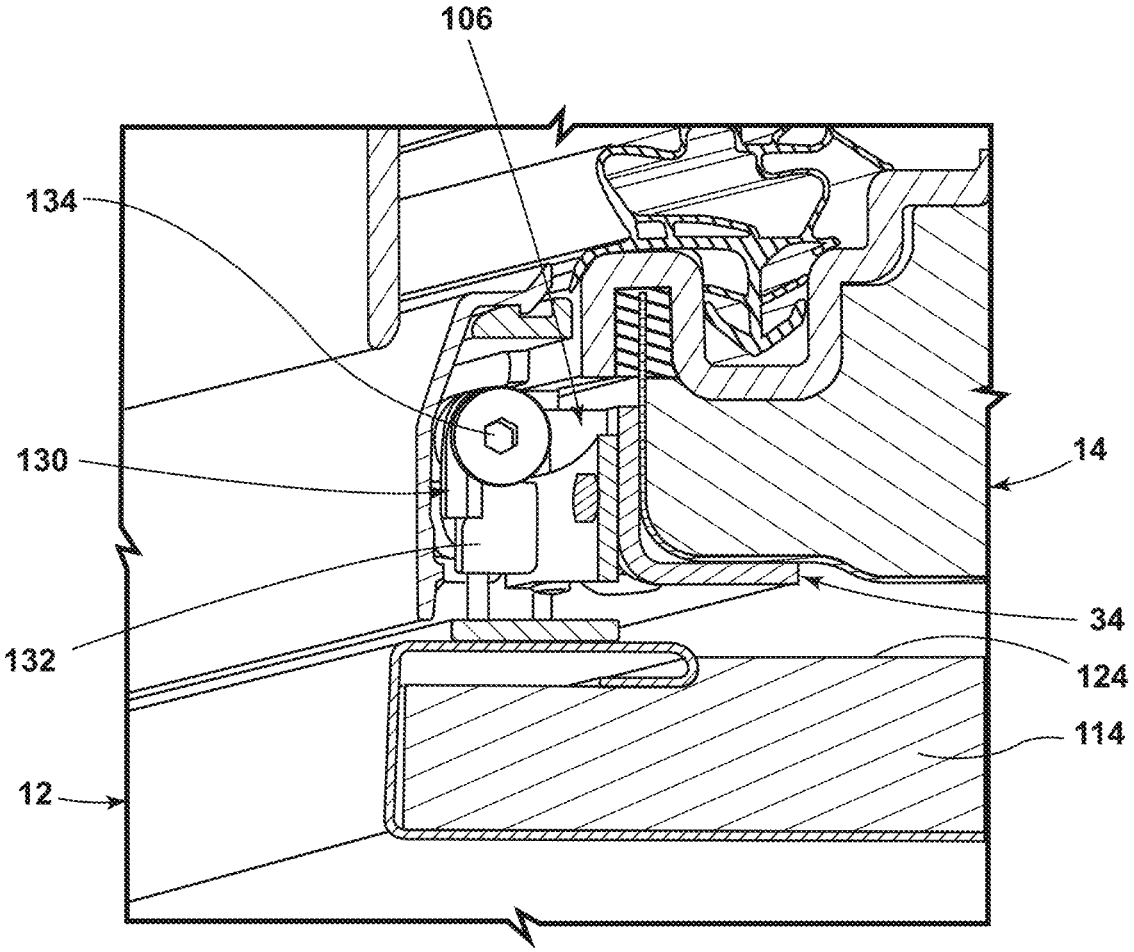
FIG. 14 is a top cross-sectional view of an adjustment mechanism for a cosmetic panel according to an aspect of the present disclosure.

The top longitudinal body 38 and the top anchor members 40 may each include an L-shape configuration with a top edge connection plate 46 and a top side-surface connection plate 48. The top edge connection plate 46 is angled from the top side-surface connection plate 48, for example, about 90°. As such, the top edge connection plate 46 on the longitudinal body 38 is coupled directly to the top edge 16, the top edge connection plates 46 on the anchor members 40 are coupled directly to the side edges 18, and the top side-surface connection plate 48 is directly coupled to a side surface of the door skin 14. For example, a front surface 50 or a rear surface 52 (FIGS. 12-14). In some embodiments, a boundary between the top edge connection plate 46 and the top side-surface connection plate 48 is rounded rather than linear. A recess 54 may be defined by the top side-surface connection plate 48 between the top longitudinal body 38 and each of the top anchor members 40 to facilitate bending or otherwise forming the angle between the top anchor members 40 and the top longitudinal body 38. The recess 54 may include oppositely tapered walls that merge upon bending the top anchor members 40 with respect to the top longitudinal body 38. In this manner, the angle between the top anchor members 40 and the top longitudinal body 38 may be retrofitted to a variety of door skin shapes.

With reference now to FIGS. 5 and 6, the front surface 50 of the door skin 14 may define a stepped surface 56 that extends along the top edge 16 of the perimeter. The stepped surface 56 is sized to accommodate the top side-surface connection plate 48. The top bracket 24 defines at least one top hinge aperture 58 coupled to the top hinge pin 28. More particularly, the at least one top hinge aperture 58 may include a pair of top hinge apertures 58 located on the top edge connection plate 46 of the longitudinal body 38 and a top hinge aperture 58 located on the top edge connection plate 46 of at least one of the anchor members 40. The pair of top hinge apertures 58 located on the longitudinal body 38 may be spaced along the top edge 16 and located adjacent to the anchor member 40 (e.g., within about 40% of the length $L_T$). The top hinge aperture 58 located on the at least one anchor members 40 may be located adjacent to the angle between the longitudinal body 38 and the at least one anchor member 40. In this configuration, the top hinge pins 28 may be utilized for mounting to the hinge assembly 32 (FIG. 12). Each top hinge pin 28 may include a body 60 and a head 62. The head 62 is sandwiched and retained between the top bracket 24 and the top edge 16 of the door skin 14. The body 60 extends outwardly through one of the top hinge apertures 58. The head 62 may extend radially outwardly from the body 60 and defines upper and lower surfaces that are planar. In some embodiments, the above-described top hinge aperture 58 configuration may be located on one or both the anchor members 40, the first top body portion 42, and/or the second top body portion 44 for facilitating connection to either a right-opening or left-opening hinge assembly 32.

With reference now to FIG. 6, the top bracket 24 may be coupled to the door skin 14 via a plurality of spot welds 64. The spot welds 64 may be located on both the top edge connection plate 46 and the top side surface connection plate 48. In some embodiments, the spot welds 64 on the top edge connection plate 46 are staggered from the spot welds 64 on the top side-surface connection plate 48. For example, spot welds 64 on the top edge connection plate 46 may be aligned centrally between spot welds 64 on the top side-surface connection plate 48. In some embodiments, a spot weld 64 is aligned with each of the hinge apertures 58 on the top side-surface connection plate 48. A spot weld 64 may also be located between each of the hinge apertures 58 on the top edge connection plate 46.

Figure 7:
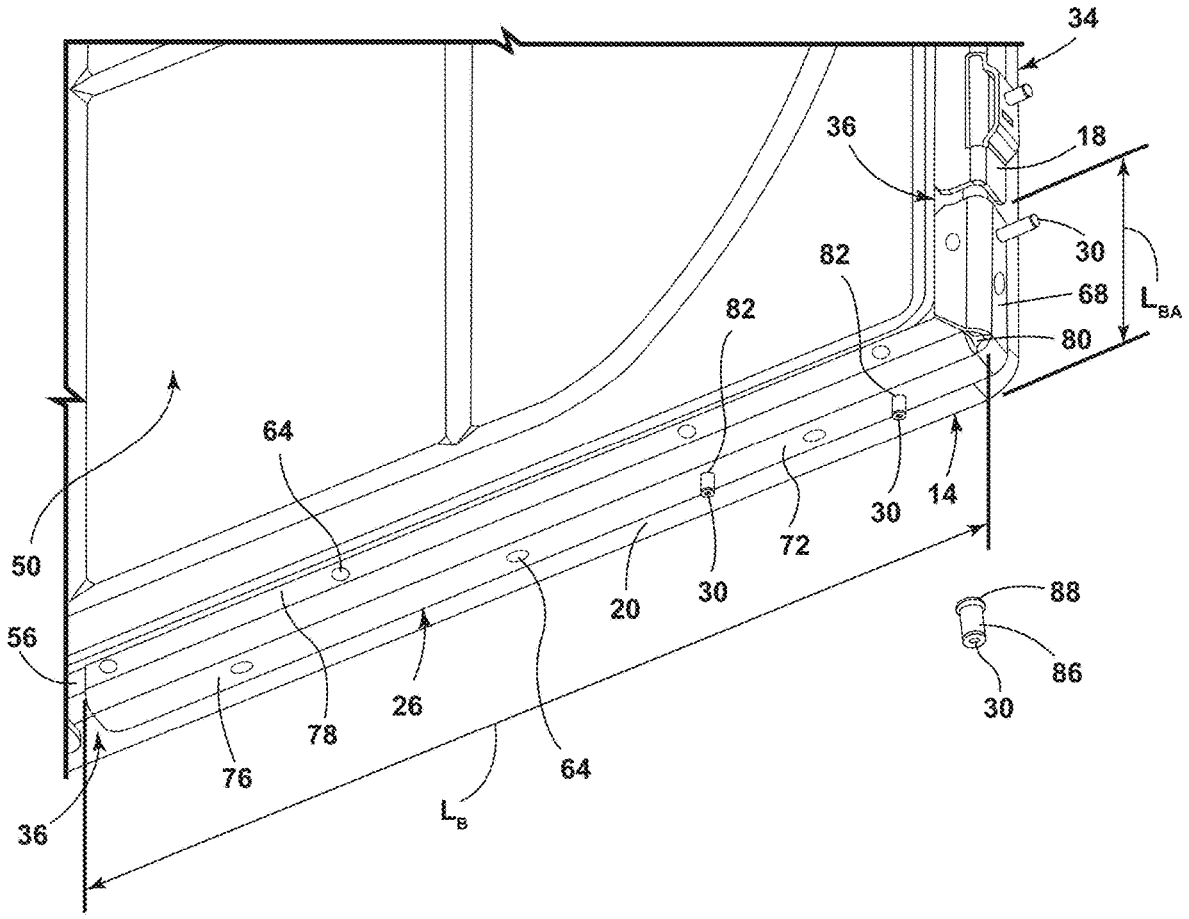
FIG. 7 is a bottom perspective view of a bottom bracket connected to a door skin according to an aspect of the present disclosure.

With reference now to FIGS. 4 and 7, the bottom bracket 26 may include a similar configuration to the top bracket 24.

More particularly, the bottom bracket 26 includes a bottom longitudinal body 66 that extends between a pair of bottom anchor members 68. The bottom longitudinal body 66 extends along the bottom edge 20 of the perimeter and the bottom anchor members 68 extend along opposite side edges 18 of the perimeter. As such, an angle (e.g., about) 90° is formed between the bottom longitudinal body 66 of each of the bottom anchor members 68. In some embodiments, the bottom bracket 26 includes a multi-piece construction such that the bottom longitudinal body 66 has a first bottom body portion 70 and a second bottom body portion 72 that are spaced from one another by one of the spaces 36. The first bottom body portion 70 is connected (e.g., integrally) to one of the bottom anchor members 68 and the second bottom body portion 72 is connected (e.g., integrally) to the other bottom anchor member 68. Each bottom body portion 70, 72 may define a length "$L_B$" and each anchor member 68 may include a length "$L_{BA}$" that is shorter than the length L B by a ratio of at least 2:1, for example, at least 3:1 or at least 4:1.

The bottom longitudinal body 66 and the bottom anchor members 68 may each include an L-shape configuration with a bottom edge connection plate 76 and a bottom side-surface connection plate 78. The bottom edge connection plate 76 is angled from the bottom side-surface connection plate 78, for example, about 90°. As such, the bottom edge connection plate 76 on the bottom longitudinal body 66 is coupled directly to the bottom edge 20, the bottom edge connection plates 76 on the anchor members 68 are coupled directly to the side edges 18, and the bottom side-surface connection plate 78 is directly coupled to a side surface of the door skin 14, for example, the front surface 50 or the rear surface 52. In some embodiments, a boundary between the bottom edge connection plate 76 and the bottom side-surface connection plate 78 is rounded rather than linear. A recess 80 may be defined by the bottom side-surface connection plate 78 between the bottom longitudinal body 66 and each of the bottom anchor members 68 to facilitate bending or otherwise forming the angle between the bottom anchor members 68 and the bottom longitudinal body 66. The recess 80 may include oppositely tapered walls that merge upon bending the bottom anchor members 68 with respect to the bottom longitudinal body 66. In this manner, the angle between the bottom anchor members 68 and the bottom longitudinal body 66 may be retrofitted to a variety of door skin shapes.

With continued reference to FIG. 7, the stepped surface 56 may extend along the bottom edge 20 of the perimeter. The stepped surface 56 is sized to accommodate the bottom side-surface connection plate 78. The bottom bracket 26 defines at least one bottom hinge aperture 82 coupled to the bottom hinge pin 30. More particularly, the at least one bottom hinge aperture 82 may include a pair of bottom hinge apertures 82 located on the bottom edge connection plate 76 of the bottom longitudinal body 66 and a bottom hinge aperture 82 located on the bottom edge connection plate 76 of at least one of the anchor members 68. The pair of bottom hinge apertures 82 located on the bottom longitudinal body 66 may be spaced along the bottom edge 20 and located adjacent to the anchor member 68 (e.g., within about 40% of the length $L_B$). The bottom hinge aperture 82 located on the at least one anchor members 68 may be located adjacent to the angle between the bottom longitudinal body 66 and the at least one anchor member 68. In this configuration, the bottom hinge pins 30 may be utilized for mounting to the hinge assembly 32 (FIG. 12). Each bottom hinge pin 30 may include a body 86 and a head 88. The head 88 is sandwiched and retained between the bottom bracket 26 and the bottom edge 20 of the door skin 14. The body 86 extends outwardly through one of the bottom hinge apertures 82. The head 88 may extend radially outwardly from the body 86 and defines upper and lower surfaces that are planar. In some embodiments, the above-described bottom hinge aperture 82 configuration may be located on one or both the anchor members 68, the first bottom body portion 70, and/or the second bottom body portion 72 for facilitating connection to either a right-opening or left-opening hinge assembly 32.

With continued reference to FIG. 7, the bottom bracket 26 may be coupled to the door skin 14 via a plurality of spot welds 64. The spot welds 64 may be located on both the bottom edge connection plate 76 and the bottom side-surface connection plate 78. In some embodiments, the spot welds 64 on the bottom edge connection plate 76 are staggered from the spot welds 64 on the bottom side-surface connection plate 78. For example, spot welds 64 on the bottom edge connection plate 76 may be aligned centrally between spot welds 64 on the bottom side-surface connection plate 78. In some embodiments, a spot weld 64 is aligned with each of the hinge apertures 82 on the bottom side-surface connection plate 78. A spot weld 64 may also be located between each of the hinge apertures 82 on the bottom edge connection plate 76.

Referring to FIGS. 8-12, the side brackets 34 may each be mirror images of one another. Each side bracket 34 includes an L-shape configuration with a side edge connection plate 90 and a side surface connection plate 92. The side edge connection plate 90 is angled from the side surface connection plate 92, for example, about 90°. As such, the side edge connection plate 90 is coupled directly to one of the side edges 18 and the side surface connection plate 92 is coupled directly to a side surface of the door skin 14, for example, the front surface 50 or the rear surface 52. The stepped surface 56 may extend along the side edges 18 of the perimeter. The stepped surface 56 is sized to accommodate the side surface connection plate 92. Each side bracket 34 may extend between a top end 94 and a bottom end 96, the top end 94 may be spaced from the top anchor member 40, and the bottom end 96 may be spaced from the bottom anchor member 68.

Figure 9:
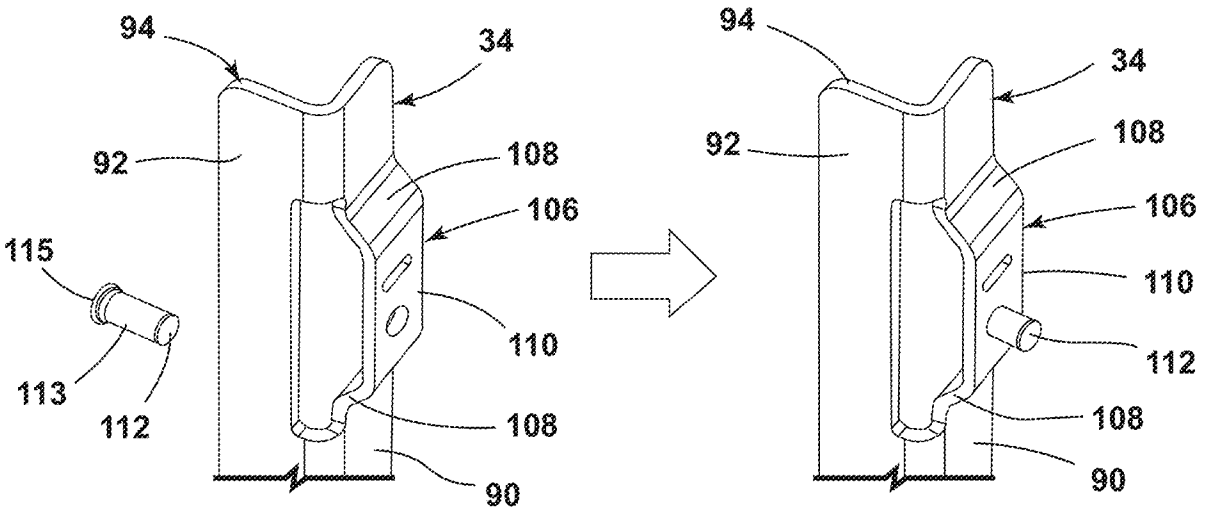
FIG. 9 is a side perspective view of a brace on a side bracket according to an aspect of the present disclosure.
Figure 10:
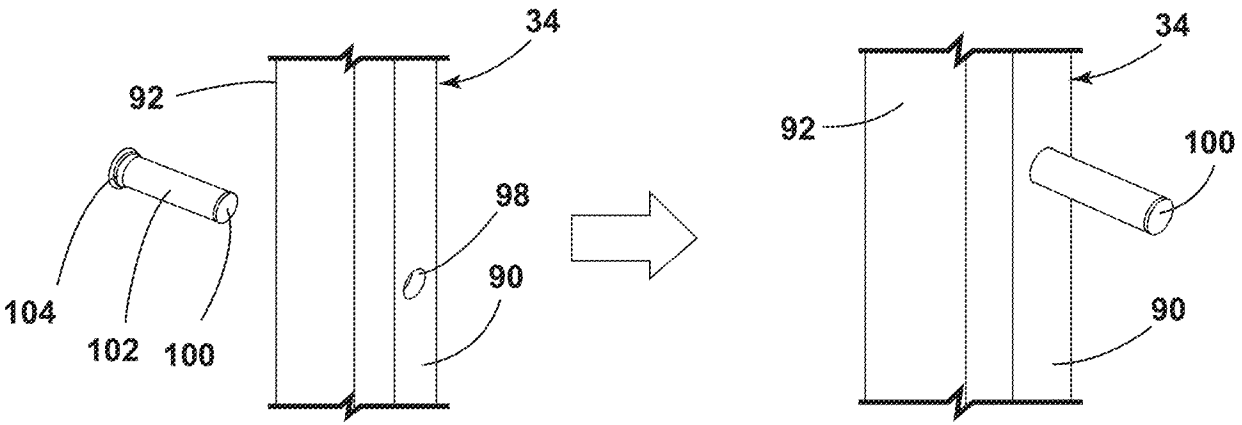
FIG. 10 is a side perspective view of a side pin aperture on a side bracket according to an aspect of the present disclosure.
Figure 8:
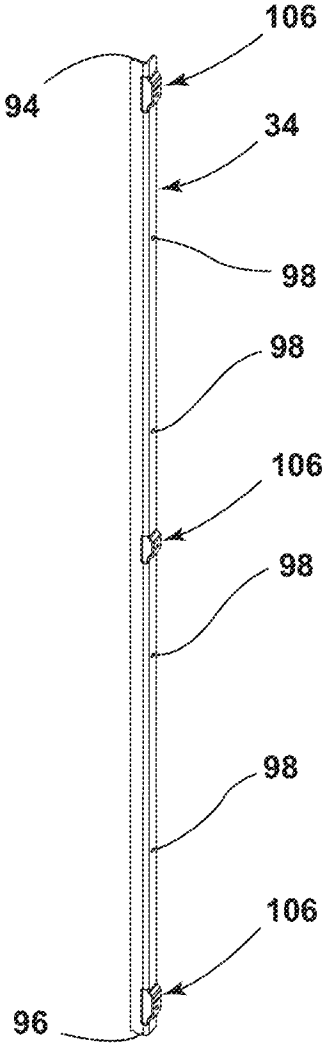
FIG. 8 is a side perspective view of a side bracket according to an aspect of the present disclosure.
Figure 11:
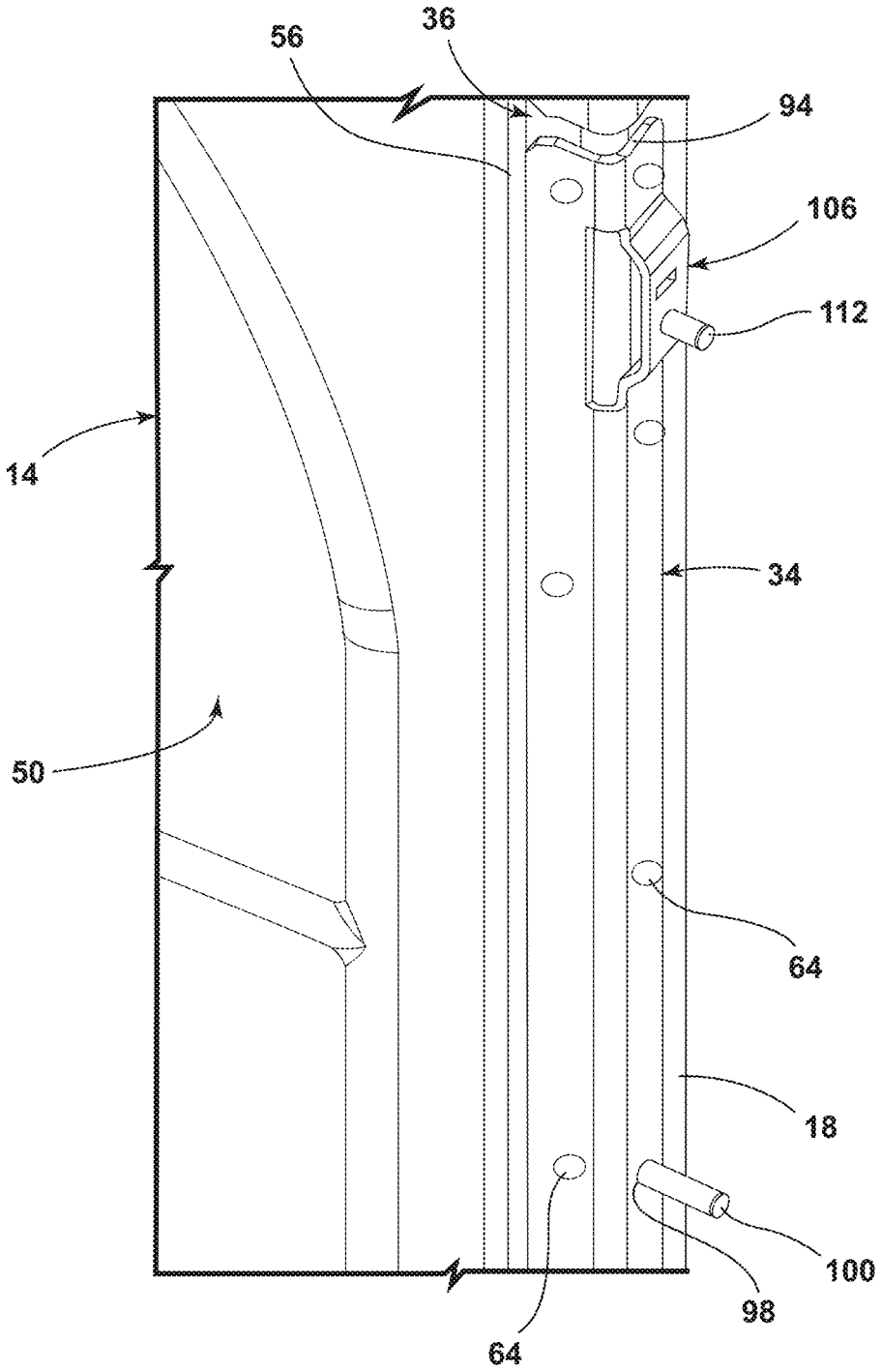
FIG. 11 is a side perspective view of a side bracket connected to a door skin according to an aspect of the present disclosure.

The side bracket 34 defines at least one side hinge aperture 98 coupled to a side pin 100. More particularly, the at least one side hinge aperture 98 (FIG. 10) may include a plurality of side hinge apertures 98 located on the side edge connection plate 90. Each side pin 100 may include a body 102 and a head 104. The head 104 is sandwiched and retained between the side bracket 34 and the side edge 18 of the door skin 14. The body 102 extends outwardly through one of the side hinge apertures 98. The head 104 may extend radially outwardly from the body 102 and defines upper and lower surfaces that are planar. Each side bracket 34 defines at least one brace 106 that includes a pair of side walls 108 that extend outwardly from the door skin 14 to a top wall 110 that is spaced from the door skin 14 (FIGS. 9 and 10). An adjustable pin 112 extends through the top wall 110 and is configured to adjustably couple a cosmetic panel 114 (FIGS. 13 and 14) over the door skin 14. The adjustable pin 112 may include a body 113 and a head 115 that extends radially outwardly from the body 113 and is retained against the top wall 110 as the body 113 extends therethrough. In some embodiments, the at least one brace 106 includes three braces 106 with a brace 106 located adjacent to the top end 94, a brace 106 located adjacent to the bottom end 96, and a brace 106 located centrally between the top end 94 and the bottom end 96. In some embodiments, the side pin 100 may define a length that is greater than a length of the adjustable pin 112. The side bracket 34 may be coupled to the door skin 14 via a plurality of spot welds 64 on both the side edge connection plate 90 and the side surface connection plate 92 (e.g., in a staggered configuration). A spot weld 64 may also be located on either side of each brace 106. A spot weld 64 may be located on both the side edge connection plate 90 and the side surface connection plate 92 adjacent to the top end 94 and the bottom end 96.

With reference now to FIG. 12, the hinge assembly 32 is connected to the top bracket 24. The hinge assembly 32 may include a hinge plate 116 connected to one of the top hinge pins 28 (e.g., the top hinge pin 28 on the anchor member 40). The hinge plate 116 may include a bend with a first portion 118 connected to the top bracket 24 and a second portion 120 coupled to the cooling appliance 10 in a manner that permits pivotal movement of the vacuum-insulated door 12. The hinge plate 116 may further include a top plate (not shown) that extends across the top longitudinal body 38 to permit connection with the top hinge pins 28 located thereon.

With reference now to FIG. 13, one of the side pins 100 is connected to the cosmetic panel 114. The cosmetic panel 114 may include at least one connection plate 122 that extends from a rear surface 124 of the cosmetic panel 114. The at least one connection plate 122 may include a pair of connection plates 122 that extend along the side brackets 34. Each connection plate 122 includes a side pin receiving aperture 126, and the body 102 of the side pin 100 may be configured to receive a flanged nut 128 (e.g., via threaded engagement) that has a larger profile than the pin receiving aperture 126 to couple the cosmetic panel 114 to each of the side brackets 34. With reference now to FIG. 14, one of the braces 106 are illustrated. The cosmetic panel 114 may include an adjustment mechanism 130 that defines a bridge shape for fitting over the brace 106, and the body 113 of the adjustable pin 112 may extend into the adjustment mechanism 130 to couple the brace 106 thereto. The adjustment mechanism 130 may include an internal body portion 132 that is only coupled to the cosmetic panel 114. A threaded pin 134 may connect the internal body portion 132 to the adjustment mechanism 130 such that rotation of the threaded pin 134 moves the cosmetic panel 114 with respect to the brace 106 and, by extension, the door skin 14.

The invention disclosed herein is further summarized in the following paragraphs and is further characterized by combinations of any and all of the various aspects described therein.

According to one aspect of the present disclosure, a vacuum-insulated door is provided. The vacuum-insulated door includes a door skin having a perimeter defined by a top edge, a pair of side edges, and a bottom edge spaced from the top edge by the pair of side edges. A frame assembly includes a top bracket coupled to the top edge, a bottom bracket coupled to the bottom edge, and at least one top hinge pin connected to the top bracket and at least one bottom hinge pin connected to the bottom bracket. The at least one top hinge pin and the at least one bottom hinge pin are configured to connect to a hinge assembly of a cooling appliance.

According to another aspect of the present disclosure, a top bracket defines at least one top hinge aperture and a top hinge pin defines a body and a head. The head is sandwiched and retained between the top bracket and a top edge of a door skin. The body extends outwardly through the at least one top hinge aperture.

According to another aspect of the present disclosure, a bottom bracket defines at least one bottom hinge aperture and a bottom hinge pin defines a body and a head. The head is sandwiched and retained between the bottom bracket and a bottom edge of a door skin. The body extends outwardly through the at least one bottom hinge aperture.

According to another aspect of the present disclosure, at least one top hinge pin includes two or more top hinge pins, and at least one bottom hinge pin includes two or more bottom hinge pins.

According to another aspect of the present disclosure, a spot weld is located between the two or more top hinge pins, and a spot weld is located between the two or more bottom hinge pins.

According to another aspect of the present disclosure, a top bracket includes a top longitudinal body that extends along a top edge of a door skin. A pair of top anchor members on opposite sides of the top longitudinal body extend from the top longitudinal body along opposite side edges of the door skin.

According to another aspect of the present disclosure, each of a pair of top anchor members is connected to side edges of a door skin with at least one spot weld.

According to another aspect of the present disclosure, a top longitudinal body includes a first top body portion and a second top body portion that are spaced along a top edge of a door skin.

According to another aspect of the present disclosure, a top bracket and a bottom bracket each include an edge connection plate coupled to a top edge and a bottom edge of a door skin, respectively. A side surface connection plate extends at an angle from the edge connection plate and is coupled to a front surface or a rear surface of the door skin.

According to another aspect of the present disclosure, the edge connection plates are coupled to the top edge with a plurality of spot welds, and the side surface connection plates are coupled to the front surface or the rear surface with a plurality of spot welds.

According to yet another aspect, a vacuum-insulated door is provided. The vacuum-insulated door includes a door skin having a perimeter defined by a top edge, a pair of side edges, and a bottom edge spaced from the top edge by the pair of side edges. A frame assembly includes a side bracket coupled to each of the side edges, a top bracket that is coupled to and extends along the top edge. Top anchor members are coupled to and extend at least partially along each of the side edges. A bottom bracket is coupled to and extends along the bottom edge and includes bottom anchor members coupled to and that extend partially along each of the side edges.

According to another aspect of the present disclosure, a top bracket and a bottom bracket are configured to connect to a hinge assembly of a cooling appliance.

According to another aspect of the present disclosure, a top bracket and a bottom bracket each include an edge connection plate coupled to a top edge and a bottom edge of a door skin, respectively. A side surface connection plate extends at an angle from the edge connection plate and is coupled to a front surface or a rear surface of the door skin.

According to another aspect of the present disclosure, a top bracket includes a top longitudinal body having a first top body portion and a second top body portion that are spaced along a top edge of a door skin. A bottom bracket includes a bottom longitudinal body having a first bottom body portion and a second bottom body portion that are spaced along a bottom edge of the door skin.

According to another aspect of the present disclosure, a pair of side brackets each define at least one brace that includes a pair of side walls that extend outwardly from a door skin to a top wall that is spaced from the door skin. An adjustable pin extends through the top wall and is configured to adjust a cosmetic panel over the door skin.

According to another aspect of the present disclosure, each side bracket includes two or more braces.

According to another aspect of the present disclosure, a pair of side brackets each include a side aperture spaced from at least one brace. A side pin is located in each side aperture. The side pins define a length that is greater than a length of an adjustment pin.

According to yet another aspect, a vacuum-insulated door is provided. The vacuum-insulated door includes a door skin that has a perimeter defined by a top edge, a pair of side edges, and a bottom edge spaced from the top edge by the pair of side edges. A frame assembly includes a pair of side brackets, each include a side edge connection plate coupled to one of the side edges and a side-surface connection plate coupled to a front surface or a rear surface of the door skin, a top bracket that includes a top edge connection plate coupled to the top edge and a top side-surface connection plate coupled to the front surface or the rear surface of the door skin, and a bottom bracket that includes a bottom edge connection plate coupled to the bottom edge and a bottom side-surface connection plate coupled to the front surface or the rear surface of the door skin.

According to another aspect of the present disclosure, a front surface of a door skin defines a recess and a pair of side-surface connection plates, a top side-surface connection plate, and a bottom side-surface connection plate that are located in the recess.

According to another aspect of the present disclosure, a plurality of spot welds connect a pair of side brackets to side edges and a front or a rear surface of the door skin. A plurality of spot welds connect a top bracket to a top edge and the front or the rear surface of the door skin. A plurality of spot welds connect a bottom bracket to a bottom edge and the front or the rear surface of the door skin.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, and the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A vacuum-insulated door comprising:

a door skin having a perimeter defined by a top edge, a pair of side edges, and a bottom edge spaced from the top edge by the pair of side edges; and a frame assembly comprising:

a top bracket defining a top hinge aperture, the top bracket coupled to the top edge;

a bottom bracket defining a bottom hinge aperture, the bottom bracket coupled to the bottom edge; and at least one top hinge pin including a head located between the top bracket and the top edge and a body extending through the top hinge aperture away from the door skin and at least one bottom hinge pin including a head located between the bottom bracket and the bottom edge and a body extending through the bottom hinge aperture away from the door skin, wherein the at least one top hinge pin and the at least one bottom hinge pin are configured to connect to a hinge assembly of a cooling appliance.

2. The vacuum-insulated door of claim 1, further including a side bracket coupled to each of the side edges, wherein at least one of the side brackets defines at least one brace including a pair of side walls extending outwardly from the door skin to a top wall that is spaced from the door skin and an adjustable pin extends through the top wall and is configured to adjust a cosmetic panel over the door skin.

3. The vacuum-insulated door of claim 2, wherein the at least one brace includes at least two braces on the same one of the side brackets.

4. The vacuum-insulated door of claim 1, wherein the at least one top hinge pin includes two or more top hinge pins and the at least one bottom hinge pin includes two or more bottom hinge pins.

5. The vacuum-insulated door of claim 4, wherein a spot weld is located between the two or more top hinge pins and a spot weld is located between the two or more bottom hinge pins.

6. The vacuum-insulated door of claim 1, wherein the top bracket includes a top longitudinal body extending along the top edge and a pair of top anchor members on opposite sides of the top longitudinal body that extend from the top longitudinal body along opposite side edges.

7. The vacuum-insulated door of claim 6, wherein each top anchor member is connected to the side edges with at least one spot weld.

8. The vacuum-insulated door of claim 6, wherein the top longitudinal body includes a first top body portion and a second top body portion that are spaced along the top edge.

9. The vacuum-insulated door of claim 1, wherein the top bracket and the bottom bracket each include an edge connection plate coupled to the top edge and the bottom edge of the door skin respectively and a side surface connection plate extending at an angle from the edge connection plate and coupled to a front surface or a rear surface of the door skin.

10. The vacuum-insulated door of claim 9, wherein the edge connection plate of the top bracket is coupled to the top edge with a plurality of spot welds and the edge connection plate of the bottom bracket is coupled to the bottom edge with a plurality of spot welds.

11. A vacuum-insulated door comprising:

a door skin having a perimeter defined by a top edge, a pair of side edges, and a bottom edge spaced from the top edge by the pair of side edges; and a frame assembly comprising:

a side bracket coupled to each of the side edges, each side bracket defining at least one brace including a pair of side walls extending outwardly from the door skin to a top wall that is spaced from the door skin and an adjustable pin extends through the top wall and is configured to adjust a cosmetic panel over the door skin;

a top bracket coupled to and extending along the top edge and including top anchor members coupled to and extending at least partially along each of the side edges; and a bottom bracket coupled to and extending along the bottom edge and including bottom anchor members coupled to and extending partially along each of the side edges.

12. The vacuum-insulated door of claim 11, wherein the top bracket and the bottom bracket are configured to connect to a hinge assembly of a cooling appliance.

13. The vacuum-insulated door of claim 12, wherein the top bracket and the bottom bracket each include an edge connection plate coupled to the top edge and the bottom edge of the door skin respectively and a side surface connection plate extending at an angle from the edge connection plate and coupled to a front surface or a rear surface of the door skin.

14. The vacuum-insulated door of claim 13, wherein the top bracket includes a top longitudinal body having a first top body portion and a second top body portion that are spaced along the top edge and the bottom bracket includes a bottom longitudinal body having a first bottom body portion and a second bottom body portion that are spaced along the bottom edge.

15. The vacuum-insulated door of claim 11, wherein the top bracket is connected to the top edge with a plurality of spot welds and the bottom bracket is connected to the bottom edge with a plurality of spot welds.

16. The vacuum-insulated door of claim 11, wherein each side bracket includes two or more braces.

17. The vacuum-insulated door of claim 11, wherein each side bracket includes a side aperture spaced from the at least one brace and a side pin is located in each side aperture, the side pins defining a length that is greater than a length of the adjustable pin.

18. A vacuum-insulated door comprising:

a door skin having a perimeter defined by a top edge, a pair of side edges, and a bottom edge spaced from the top edge by the pair of side edges; and a frame assembly comprising:

a pair of side brackets each including a side edge connection plate coupled to one of the side edges and a side-surface connection plate coupled to a front surface or a rear surface of the door skin, wherein at least one of the side brackets defines at least one brace including a pair of side walls extending outwardly from the door skin to a top wall that is spaced from the door skin and an adjustable pin extends through the top wall and is configured to adjust a cosmetic panel over the door skin;

a top bracket including top anchor members coupled to and extending at least partially along each of the side edges and spaced from the pair of side brackets, the top bracket including a top edge connection plate coupled to the top edge and a top side-surface connection plate coupled to the front surface or the rear surface of the door skin;

a bottom bracket including bottom anchor members coupled to and extending partially along each of the side edges and spaced from the pair of side brackets, the bottom bracket including a bottom edge connection plate coupled to the bottom edge and a bottom side-surface connection plate coupled to the front surface or the rear surface of the door skin.

19. The vacuum-insulated door of claim 18, wherein the front surface of the door skin defines a recess and the side-surface connection plates, the top side-surface connection plate, and the bottom side-surface connection plate are located in the recess.

20. The vacuum-insulated door of claim 18, wherein a plurality of spot welds connect the side brackets to the side edges and the front or the rear surface of the door skin, a plurality of spot welds connect the top bracket to the top edge and the front or the rear surface of the door skin, and a plurality of spot welds connect the bottom bracket to the bottom edge and the front or the rear surface of the door skin.

* * * * *